United States Patent [19]

Sazaki et al.

[11] Patent Number: 4,990,103

[45] Date of Patent: Feb. 5, 1991

[54] PLUG WITH CORD

[75] Inventors: Toshio Sazaki, Nabari; Hisao Toramoto, Souraku, both of Japan

[73] Assignee: Hosiden Electronics Co., Ltd., Osaka, Japan

[21] Appl. No.: 554,340

[22] Filed: Jul. 19, 1990

[30] Foreign Application Priority Data

Aug. 11, 1989 [JP] Japan ..... 1-95038[U]

[51] Int. Cl.[5] ..... H01R 13/58

[52] U.S. Cl. ..... 439/455; 439/445

[58] Field of Search ..... 435/445, 449, 452, 453, 435/455, 460, 610

[56] References Cited

U.S. PATENT DOCUMENTS 4,406,512 9/1983 Schell ..... 439/460 X 4,684,199 8/1987 Ezure et al. ..... 439/610

FOREIGN PATENT DOCUMENTS 0008365 3/1971 Japan ..... 439/460

*Primary Examiner*—Eugene F. Desmond

*Attorney, Agent, or Firm*—Pollock, VandeSande and Priddy

[57] ABSTRACT

In a plug with a cord, the plug body with a plurality of contacts received in its contact receiving holes has a clamper fixing slot in its rear portion and a clamper put on the cord having its core conductors connected to the contacts has a forwardly projecting coupling piece for engagement with the clamper fixing slot. The plug body is received in a cap having at its rear end a flexible cord protecting portion, through which the cord is led out of the cap.

6 Claims, 4 Drawing Sheets

PLUG WITH CORD

BACKGROUND OF THE INVENTION

The present invention relates to a plug which has contacts housed in its body and a cord having its core conductors connected to the contacts.

FIG. 1 shows a conventional plug of this kind. In a plug body 11 of an insulating material there are housed a plurality of contacts 32, the rear ends of which are connected to core conductors 13 of a cord 12. A flexible bush 14 is put on the cord 12 and a clamper 15 is crimped around the cord 12 inside a case 17 composed of top and bottom case halves 17*a* and 17*b*. The case halves 17*a* and 17*b* are assembled together, with a flange 16 of the body 11 gripped by their forward portions therebetween and their rear panels received in a peripheral groove of the bush 14. Thus, the body 11 and the cord 12 are held by the case halves 17*a* and 17*b*. With such a structure, even if the cord 12 is pulled, the clamper 15 will get caught in the case 17 through the bush 14, preventing any external force from being applied to the connections between the contacts 32 and the core conductors 13.

In the conventional plug the top and bottom case halves 17*a* and 17*b* must be rigid so as to ensure that no force will be applied to the connections between the contacts 32 and the core conductors 13 when the cord 12 is pulled. The flexible bush 14 is used to meet the requirements that the part through which the cord 12 is let out of the case 17 is flexible and that the flexure or bending of the cord lead-out part does not degrade the cord 12. The number of parts used increases accordingly.

Moreover, since the body 11 and the clamper 15 are held apart in the conventional plug, the relative positions of the body 11 and the bush 14 are not stable, introducing difficulty in putting the body 11 and the bush 14 between the case halves 17*a* and 17*b*.

SUMMARY OF THE INVENTION

It is therefore an object of the present invention to provide a plug with a cord which is lower in the number of parts used and is easy of assembly.

According to the present invention, the clamper on the cord has a forwardly extending coupling piece, which is fitted in a slot made in the bottom of the plug body. The plug body is received in the forward portion of a cylindrical cap, with the cord led out therefrom at the rear end thereof. The rear end portion of the cap is flexible so as to protect the cord.

DESCRIPTION OF THE PREFERRED EMBODIMENT

Figure 1:
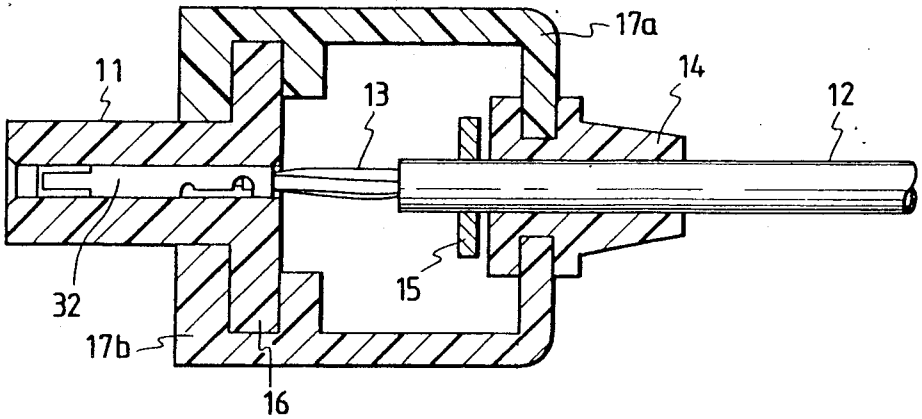
FIG. 1 PRIOR ART
FIG. 1 is a sectional view showing a conventional plug with a cord.
Figure 2:
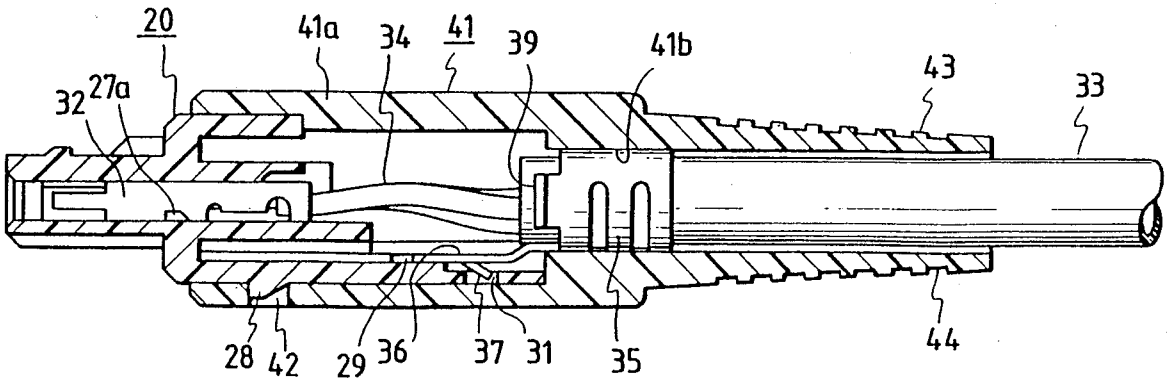
FIG. 2 is a longitudinal-sectional view illustrating an embodiment of the present invention.
Figure 3:
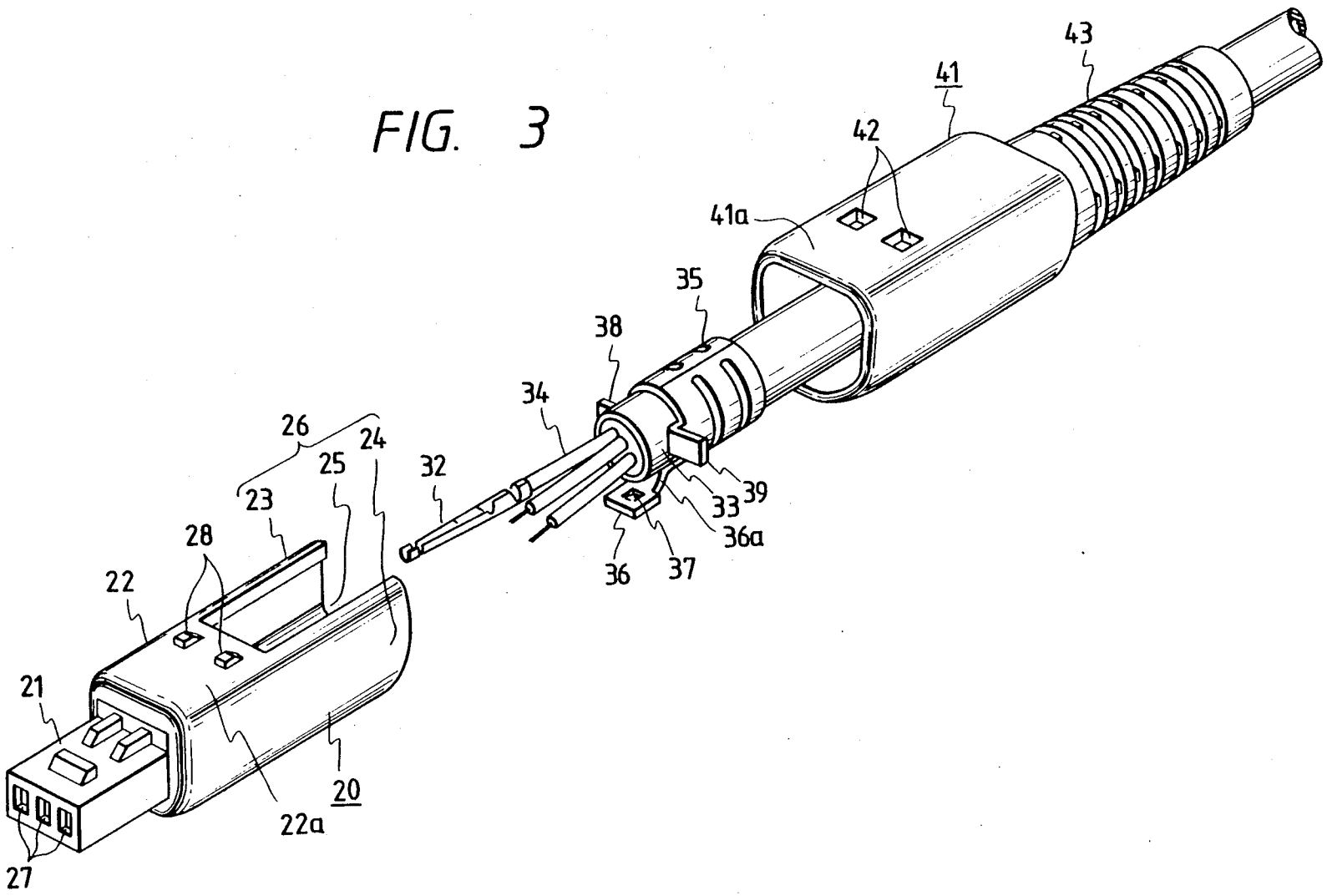
FIG. 3 is its exploded perspective view, with a body 20 and a cap 41 taken away.
Figure 4:
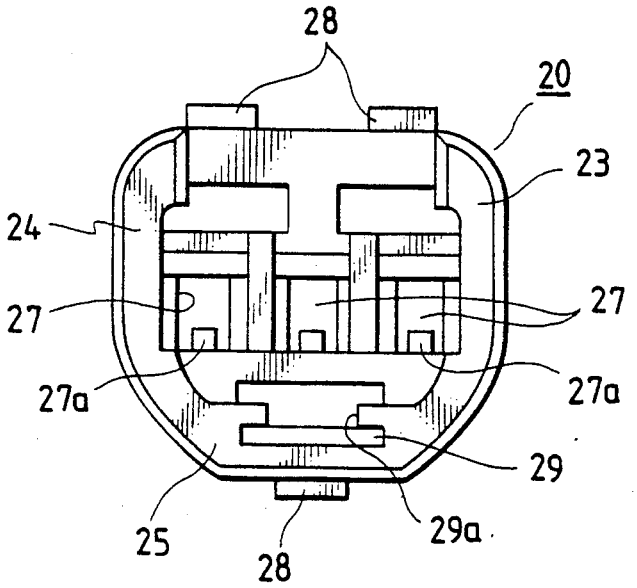
FIG. 4 is a rear view of the body 20.
Figure 5:
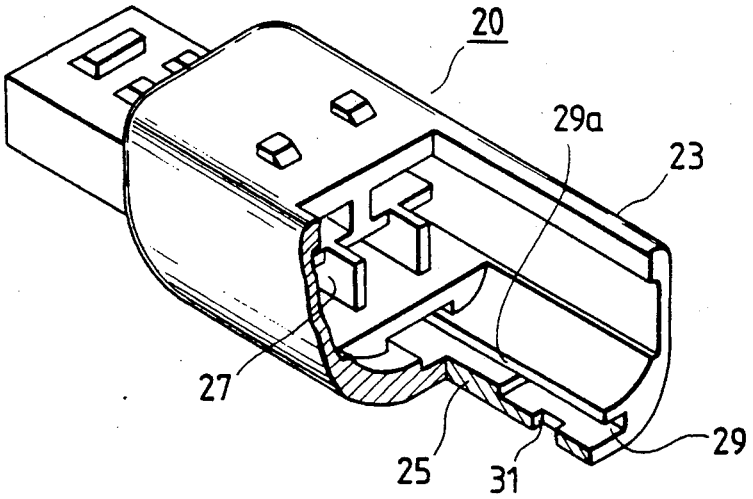
FIG. 5 is a perspective view, partly in section, showing the body.

FIGS. 2 through 6 illustrate an embodiment of the present invention. The body 20 is a molding of synthetic resin, which has a thin rectangular forward portion 21 which is inserted in the mating socket and an intermediate portion 22 which has a flat top 22*a* and a U-shaped cross-section defined by its right, left and bottom panels. The right, left and bottom panels of the intermediate portion 22 are extended rearward to form a coupling portion 26 of a U-shaped cross-section defined by both side panels 23 and 24 and the bottom panel 25. That is, the coupling portion 26 is open to the above. In the body 20 there are formed a plurality of contact receiving holes 27 which extend through the forward portion 21 and the intermediate portion 22 and open to the coupling portion 26. The intermediate portion 22 has tapered engaging lugs 28 set up from its top 22*a*. In the present invention, as shown in FIGS. 2, 4 and 5, the body 20 has a clamper fixing slot 29 extending forward from the rear end edge of the bottom panel 25 and an engaging hole 31 made in the bottom panel 25 a little inside its rear end edge. The slot 29 is open to the inside of the coupling portion 26 through a passage 29*a* narrower than the slot 29.

The contact receiving holes 27 have each received therein a contact 32 inserted thereinto from the back of the body 20 and locked to a lug 27*a* protrusively provided on the inner wall of the hole 27. Core conductors 34 of a cord 33 are each connected to one of the contacts 32 at the rear end thereof. Although in FIG. 3 only one contact 32 is shown to be connected to one core conductor 34, the contacts 32 are similarly connected to the other core conductors 34 as well.

Figure 6:
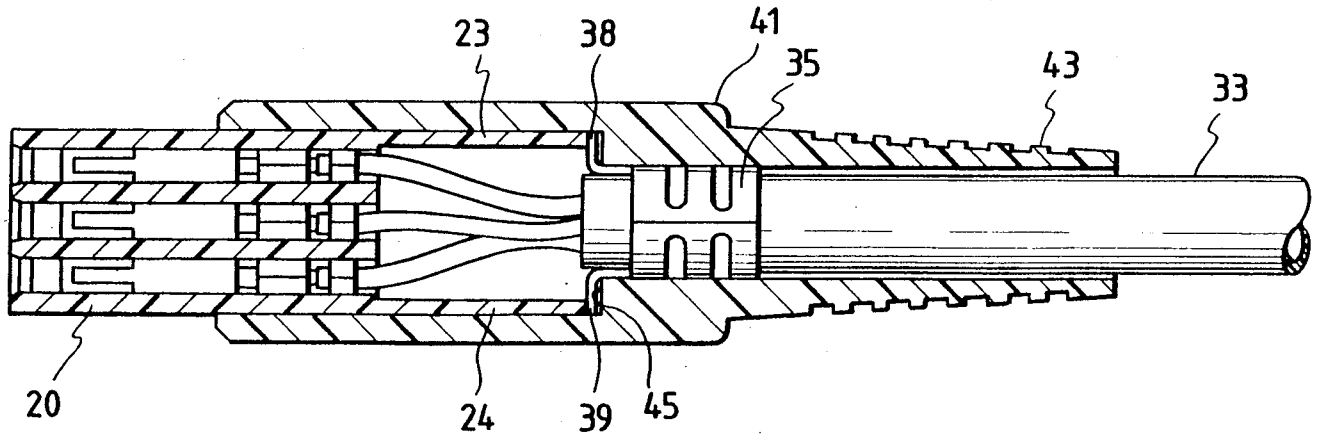
FIG. 6 is a sectional view showing the relationship among wings 38 and 39 of a clamper 35, the body 20 and the cap 41.

A clamper 35 is crimped around the cord 22 at its one end portion near the body 20. The clamper 35 is produced by bending a metal plate into a U-letter shape. The U-shaped clamper 35 is put on the cord 33 and is then crimped with its both leg portions bent around the peripheral surface of the cord 33. In the present invention, the clamper 35 has an arm 36*a* which extends forward from the center portion of its front edge and is narrower than the passage 29*a*, and the arm 36*a* has at its tip a coupling piece 36 extending forwardly thereof and having about the same width as the clamper fixing slot 29, the coupling piece 36 having a downward claw 37. The claw 37 is coupled at its forward end to the coupling piece 36, with its tip facing backward. The coupling piece 36 is pressed into the clamper fixing slot 29 of the body 20, engaging the claw 37 with the recess 31. At this time, the arm 36*a* extends into the clamper fixing slot 29 from the coupling portion 26 through the passage 29*a*. Thus, the clamper 35 is locked to the body 20, and consequently, the position of the body 20 is fixed relative to the clamper 35. The clamper 35 has L-shaped wings 38 and 39 extending from its front edge to the right and left. As depicted in FIG. 6, the distance between the tips of the wings 28 and 39 is almost equal to the distance between the outer wall surfaces of the side panels 23 and 24 of the body 20.

The coupling portion 26 and the intermediate portion 22 of the body 20 are fitted into a body receiving compartment 41*a* of an elastic cylindrical cap 41 which is a molding of synthetic resin. In this instance, the body 20 is pressed into the cap 41 until the lugs 28 of the former are engaged with holes 42 made in the top wall of the latter, so as to prevent the former from coming off the latter. In this state the forward portion 21 of the body 20 projects out of the cap 41. The end wall of the body receiving compartment 41*a* has a hole 41*b* of a diameter smaller than the inner diameter of the compartment 41*a* but substantially equal to the outer diameter of the cord 33. The cord 33 is led out of the cap 41 through the hole 41*b*. The rear end portion of the cap 41 forms a flexible portion 43 for protecting the cord 33. The flexible portion 43 is formed, for example, by cutting circumferential slots in the rear end portion of the cap 41 in side-by-side relation lengthwise thereof. As illustrated in FIG. 6, the clamper 35 is received in the cord lead-out hole 41*b* with the wings 38 and 39 of the former firmly held between the rear end face of the body, i.e. the rear ends of the side panels 23 and 24 and stepped portions 45 made in the end wall of the body receiving compartment 41*a*. Thus, the cord 22 cannot be pulled out of the plug.

As described above, according to the present invention, the clamper 35 is fixed to the body 20 so that when the cord 33 is pulled, the force is applied from the clamper 35 to the body 20 and is not applied to the connections between the contacts 32 and the core conductors 34. Moreover, since the pulling force is not applied to the cap 41, the cap 41 need not be formed rigid and hence can be formed as a unitary structure with the flexible portion 43. Accordingly, the number of parts used is smaller than in the prior art which calls for the bush 14.

Further, since the clamper 35 is fixed to the body 20, the cap 41 can easily be put on the body 20.

It will be apparent that many modifications and variations may be effected without departing from the scope of the novel concepts of the present invention.

What is claimed is:

1. A plug comprising:

a plug body made of an insulating material and having a plurality of contact receiving holes extending therethrough in the front-to-back direction, a clamper fixing slot made in its rear end portion and engaging lugs protrusively provided on its outer peripheral surface;

a plurality of contacts received in said contact receiving holes of said plug body;

a cord having its core conductors each connected to one of said contacts;

a clamper crimped around said cord and having a forwardly extending coupling piece inserted in and locked to said clamper fixing slot of said plug body; and a cylindrical cap made of an insulating material and having holes for engagement with said lugs of said plug body, for receiving said plug body in its forward portion, said cap having at its rear end an integral flexible cord protecting portion and said cord being led out of said cap through said cord protecting portion.

2. The plug of claim 1, wherein said clamper fixing slot has an engaging recess made in its inner wall surface and said coupling piece has a claw set up therefrom for engagement with said engaging recess to prevent said plug body from coming off said cap.

3. The plug of claim 1, wherein said clamper has a pair of wings extending from its front edge in diametrically opposite directions for engagement with stepped portions made in the end wall in said cap.

4. The plug of claim 3, wherein said wings are held between said stepped portions and the rear end of said plug body.

5. The plug of claim 1, 2, 3, or 4, wherein said plug body has an intermediate portion having said engaging lugs protrusively provided on its outer peripheral surface, a forward portion extending forwardly of the front of said intermediate portion and a U-letter sectioned coupling portion formed by rearward extensions of both side walls and a bottom wall of said intermediate portion, said contact receiving holes are formed so that they extend from the front of said forward portion to said coupling portion, and said coupling portion and said intermediate portion are received in said cap.

6. The plug of claim 5, wherein said clamper fixing slot extends forwardly from the rear end face of said bottom wall of said coupling portion.

* * * * *